US005379602A

United States Patent [19]

Sipilä et al.

[11] Patent Number: 5,379,602

[45] Date of Patent: Jan. 10, 1995

[54] METHOD FOR PROVIDING COOLING AND A COOLING APPARATUS SUITED FOR THE SAME

[75] Inventors: Heikki Sipilä; Sakari Viitamäki, both of Espoo, Finland

[73] Assignee: Outokumpu Instruments Oy, Espoo, Finland

[21] Appl. No.: 92,260

[22] Filed: Jul. 14, 1993

[30] Foreign Application Priority Data

Jul. 15, 1992 [FI] Finland ..... 923237

[51] Int. Cl.[6] ..... F25B 19/02

[52] U.S. Cl. ..... 62/51.2; 62/383

[58] Field of Search ..... 62/51.1, 51.2, 383

[56] References Cited

U.S. PATENT DOCUMENTS

| | | | |
|---|---|---|---|
| 3,170,306 | 2/1965 | Gross, Jr. et al. | 62/383 |
| 3,369,370 | 2/1968 | Todd, Jr. et al. . | |
| 3,413,821 | 12/1968 | Villaume et al. | 62/51.2 |
| 3,922,878 | 12/1975 | Jalali . | |
| 4,212,169 | 7/1980 | Kneip, Jr. . | |
| 4,419,867 | 12/1983 | Albagnac et al. | 62/51.2 |
| 4,569,210 | 2/1986 | Albagnac | 62/51.2 |
| 4,873,843 | 10/1989 | Volten | 62/383 |
| 5,012,650 | 5/1991 | Longsworth | 62/51.2 |

FOREIGN PATENT DOCUMENTS

| | | |
|---|---|---|
| 814184 | 6/1983 | Finland . |
| 1477028 | 6/1977 | United Kingdom . |
| 2178836 | 2/1987 | United Kingdom . |

*Primary Examiner*—Ronald C. Capossela
*Attorney, Agent, or Firm*—Smith-Hill and Bedell

[57] ABSTRACT

The invention relates to a method and apparatus for providing cooling in a reloadable cooling apparatus, which can be used in actuators requiring low temperatures. According to the invention, the loading of at least one cooling element (2, 22, 32), located in the vacuum of the cooling apparatus, is carried out through at least one cooling surface (4, 25, 34), connected to outside the cooling apparatus (1, 21, 31), and the period between two loadings is extended by reducing the transversal area of the supporting member (3, 23, 33) and by reducing the heat conduction distance of the supporting member (3, 23, 33) of the cooling element from the cooling apparatus (1, 21, 33), advantageously by shaping the supporting member (3, 23, 33).

23 Claims, 2 Drawing Sheets 1
2
3
4
5
6
7
8
9
10

Figure 1:
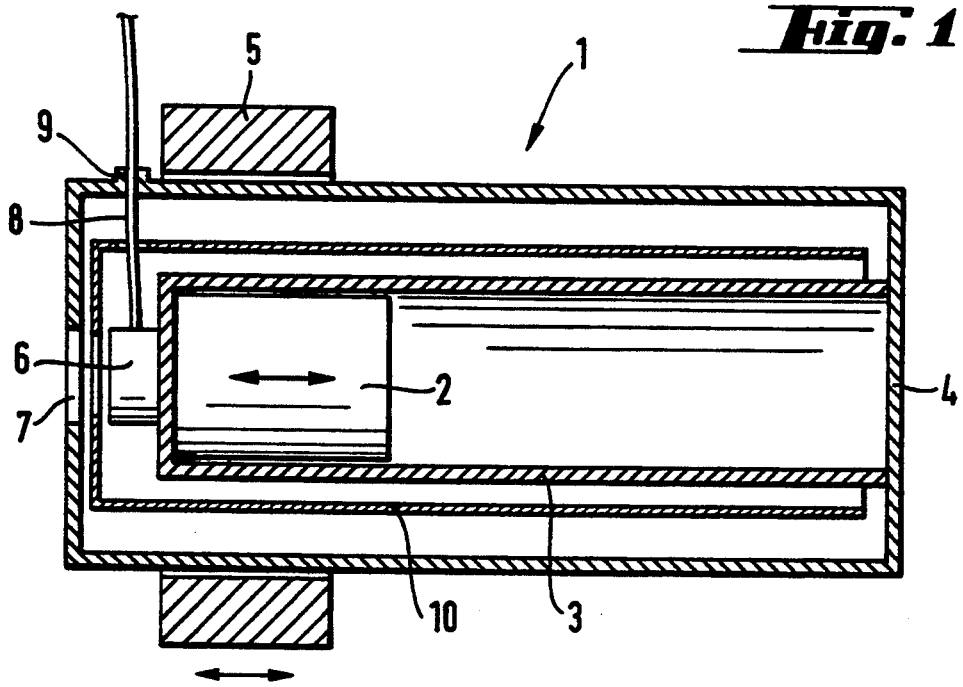

21
22
23
23
24
25
26
27
28
29
30
32
32

METHOD FOR PROVIDING COOLING AND A COOLING APPARATUS SUITED FOR THE SAME

The present invention relates to a method for providing cooling in a reloadable cooling apparatus, which is employed for cooling detectors to be used in actuators that require low temperatures, such as analyzers, particularly portable analyzers, down to the operating temperature.

When analyzing various samples for instance with an analyzer employing a semiconductor or germanium detector, the probe of the analyzer must be cooled down to a low temperature, advantageously below −100° C. Liquid nitrogen is generally used for this type of cooling; the probe of the analyzer is connected to a chamber filled with liquid nitrogen. In order to keep the probe at a desired low temperature, some cooling liquid, i.e. liquid nitrogen, must be added to the chamber from time to time. However, the submersion of the probe to the cooling liquid increases the total weight of the actuator. If the analyzer in question is a stationary device, the resulting increase in weight does not cause remarkable problems. On the other hand, if the said cooling should be applied to a portable device, the cooling liquid as well as the structural parts provided for the said liquid usually cause a radical increase in the weight of the actuator.

The object of the present invention is to eliminate some drawbacks of the prior art and to achieve an improved method for cooling various actuators, such as portable semiconductor detectors, and a cooling apparatus which is advantageously reloadable. The essential novel features of the invention are apparent from the appended patent claims.

According to the invention, a vacuum is created in a closed cooling apparatus, and inside the said cooling apparatus, there is installed at least one cooling element according to the invention; while reloading the said cooling element, the cooling takes place through at least one particular cooling surface connected to the exterior of the cooling apparatus. The cooling element can be either solid or hollow inside. A hollow cooling element is advantageously filled with at least one organic or inorganic substance or a combination of these, so that the phase transformation from solid to liquid takes place within the temperature range −273°–+1° C., advantageously −200°–−100° C. In outlook, the cooling element is advantageously for instance ball-shaped, cylindrical or the like, depending, among others, on the actuator to be cooled. In the method of the invention, the cooling surface used for reloading the cooling apparatus is connected to the exterior of the cooling apparatus either via a specific outlet leading through the wall of the cooling apparatus, or the reloading of the cooling apparatus is carried out by bringing the cooling effect first from the exterior of the cooling apparatus to a specific cooling piece, which by radiation further transmits the cooling effect to the cooling element to be cooled.

In order to decrease heat losses in the cooling apparatus of the invention, at least one of the surfaces located inside the closed cooling apparatus, such as the interior surface and/or the exterior surface thereof, advantageously has—at least partly—a low emission coefficient, between 0.01 –0.3, whereby heat losses caused by radiation are reduced. Such surface materials with a low emission coefficient are advantageously for instance aluminum, steel and copper or combinations thereof. Thus for example aluminum-coated steel can be used in the cooling apparatus and as the frame material of the cooling element located inside the cooling apparatus. In order to decrease heat losses caused by heat conduction, the conductive length in between the cooling apparatus and the cooling element is advantageously made long, and the conductive transversal area is made small by means of a design where the supporting structures of the cooling element, at least one in number, which support the cooling element against the wall of the cooling apparatus, are either thin and long and essentially equal in transversal area, or a groove is made to the supporting member, which essentially reduces the transversal area of the support member and simultaneously extends the conductive length between the wall of the cooling apparatus and the cooling element. According to the invention, by advantageously designing the supporting members of the cooling element of the cooling apparatus, the conduction losses advantageously fall within the range $10^{-6}$—100 W, and for a portable device advantageously 0.001–0.3 W.

The cooling element located inside the cooling apparatus of the invention can advantageously be filled with for example liquid, such as ethanol, or with liquidized gas, such as propane or nitrogen. The temperature of the filled, hollow cooling element is kept essentially constant in between the reloadings by means of the heat capacity connected to the phase transformation. Thus an even temperature for the whole operation period is achieved for the actuator to be cooled, in between two separate loadings. During the use of the cooling apparatus of the invention, heat losses to the environment are advantageously minimized for instance with respect to radiation by using radiation shields.

The cooling element of a cooling apparatus of the invention can be installed inside the cooling apparatus either so that the cooling element remains essentially in place all the time with respect to the closed cooling apparatus, or so that the cooling element can be moved within the cooling apparatus. When installing the cooling element to be essentially stationary inside the cooling apparatus, the cooling element is advantageously supported against the cooling apparatus constituting a vacuum by means of wires that keep the cooling element in place, so that the cooling element does not touch the wall of the cooling apparatus. In the vacuum the under pressure is advantageously at least $10^{-3}$ mbar. In order to prevent heat conduction, the supporting members of the cooling element are essentially long as for heat conductivity and essentially small as for their transversal area; they also have poor heat conductivity, with a conductivity coefficient 0.01–150 W/mK, advantageously 0.1–15 W/mK. The material used in the supporting members is for instance metal, such as tungsten, or a mixture of glass fiber and epoxy. When the cooling element is installed movably inside the cooling apparatus, the supporting member provided around the cooling element is advantageously for instance a sleeve, inside which sleeve the cooling element can be moved for example by means of magnetism, a mechanical transmission member or gravitation.

Figure 2:
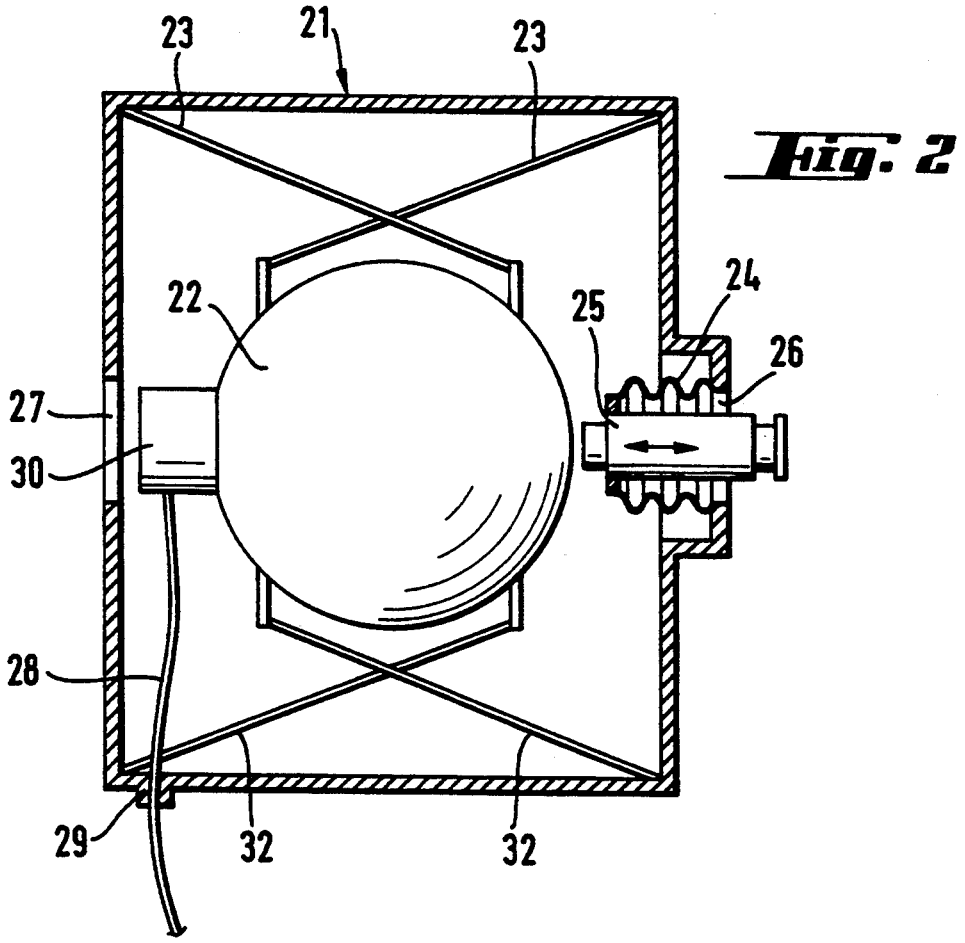
Figure 3:
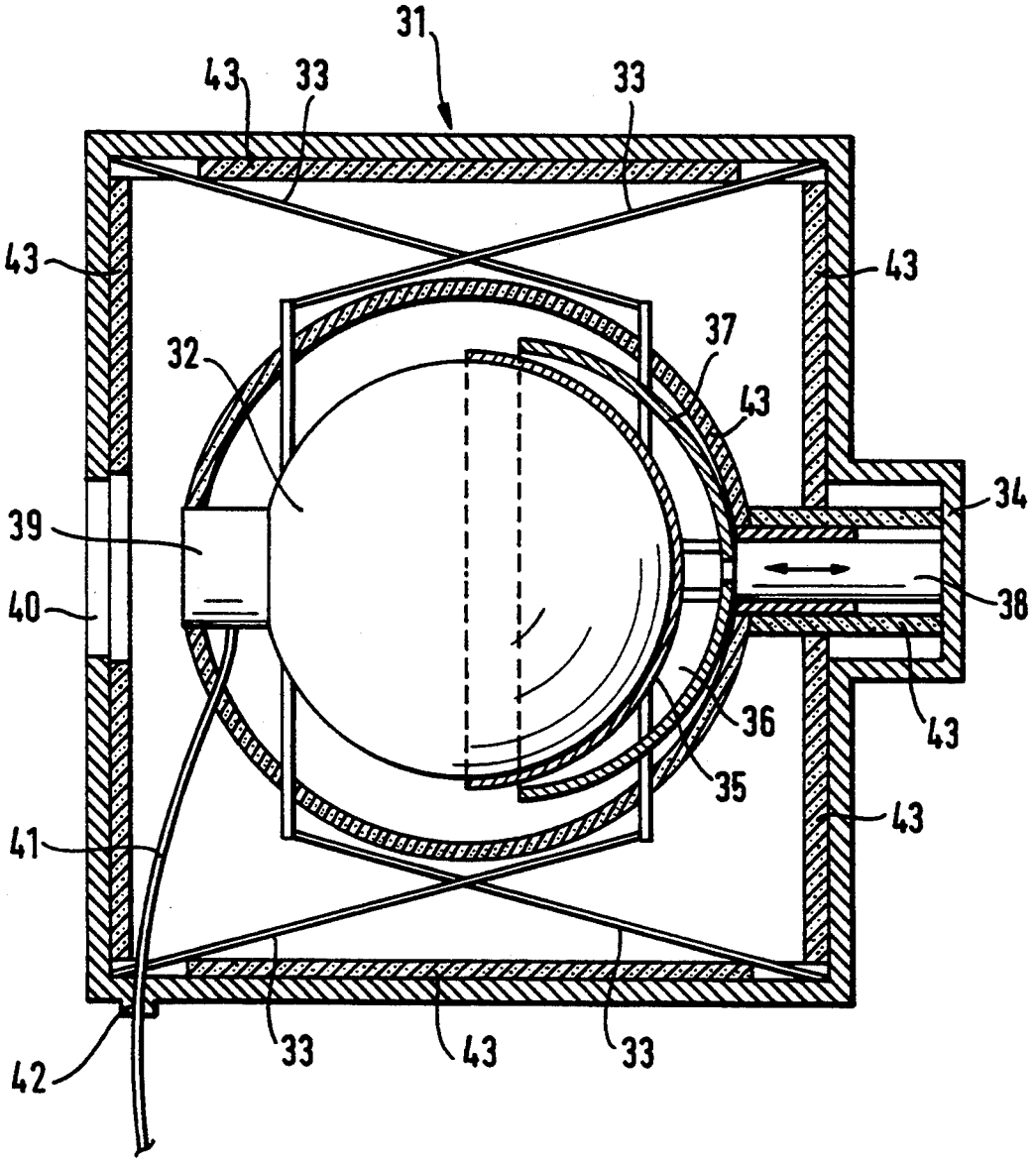

The method and apparatus of the invention are explained in more detail below, with reference to the appended drawings, where FIG. 1 is a side-view illustration of a preferred embodiment of the invention, seen in partial cross-section;

FIG. 2 is a side-view illustration of another preferred embodiment of the invention, seen in partial cross-section; and FIG. 3 is a side-view illustration of yet another preferred embodiment of the invention, seen in partial cross-section.

According to FIG. 1, inside the cooling apparatus 1 constituting a vacuum, there is installed a cooling element 2 that can be cooled. In shape, the cooling element 2 is a cartridge, and a sleeve 3 is provided around it. At one end, the sleeve 3 is attached to the cooling apparatus 1. The common fastening surface 4 of the cooling apparatus 1 and the sleeve 3 forms the cooling surface of the cooling apparatus of the invention, through which cooling surface the coolable cooling element 2 is cooled. While loading, i.e. cooling the cooling element 2, the cooling element 2 is first shifted to the vicinity of the cooling surface 4. From outside the cooling apparatus 1, there is conducted a cooling effect to the cooling surface 4 for instance by means of liquid nitrogen, which cooling effect is advantageously transferred to the cooling agent, liquid or liquidized gas, provided inside the cooling element 2. After loading the cooling apparatus of the invention, the cooling element 2 is shifted, by means of magnetism caused by a solenoid 5 located outside the cooling apparatus, to the opposite end of the sleeve 3, where a semiconductor detector 6 is arranged; the cooling apparatus of the invention is used for cooling this semiconductor detector. Depending on the application in question, the semiconductor detector 6 measures, for instance through a measuring window 7 arranged in the wall of the cooling apparatus 1, the intensity of incoming radiation. From the semiconductor detector 6, the radiation-form information to be analyzed is conducted to further processing through a cable 8 via an outlet 9 provided in the wall of the cooling apparatus. For an advantageous operation of the cooling apparatus of the invention, the cooling element 2 is surrounded by a radiation shield 10, which reduces the heat losses caused by radiation. In order to decrease the heat losses caused by conduction, the transversal area of the sleeve 3 is advantageously minimized, whereas the conductive length between the cooling element 2 and the cooling surface 4 is made as long as possible, for instance by providing the sleeve 3 with a spring having a small angle of ascent. Thus the interval between reloadings is extended, advantageously to be 10–50 h.

In FIG. 2, inside the cooling apparatus 21 there is formed a vacuum, and in this vacuum there is installed a coolable ball-shaped cooling element 22 of the invention. The cooling element 22 is installed in an essentially stationary fashion in the cooling apparatus 21, so that the cooling element 22 is supported against the walls of the cooling apparatus 21 by means of wires 23. When cooling, i.e. loading, the cooling element 22, the bellows member 24 attached to the wall of the cooling apparatus 21, which member contains the cooling surface 25 needed for cooling the cooling element 22, is moved so that the cooling surface 25 comes into contact with the cooling element 22. The cooling surface 25, bar-like in shape, is connected to the outlet 26 passing through the wall of the cooling apparatus 21, through which outlet 26 the desired cooling effect is conducted to the cooling surface 25. Through the cooling surface 25, the cooling element 22 is likewise cooled. After cooling, i.e. loading, the cooling element 22, the cooling surface 25 is shifted back to its rest position by using the bellows member 24. To the cooling element 22, there is further connected a coolable semiconductor detector 30, which measures, depending on the application in question, the intensity of the radiation entering for instance through the measuring window 27. From the semiconductor detector 30, the information obtained in radiation form is connected along the cable 28 and via the outlet 29 to further processing.

In the embodiment of FIG. 3, inside the cooling apparatus 31 there is installed, in an essentially stationary fashion, a cooling element 32 to be cooled according to the method of the invention, which cooling element 32 is supported to the wall of the cooling apparatus 31 by means of wires 33. In the surface of the cooling element 32, mainly in the area located nearest to the wall 34 of the cooling apparatus serving as the cooling surface, there is formed a surface 35 with a high emission coefficient. In the space 36 located in between the surface 35 and the radiation shield 43 provided around the cooling element 32, there is at least partly located a cooling piece 37 made of some material with a high emission coefficient, such as graphite. Advantageously the cooling piece 37 is designed so that at least one part thereof is extended to the exterior of the space 36, to the vicinity of the wall 34 serving as the cooling surface, via the outlet 38 provided in the cooling element. When cooling, i.e. loading, the cooling element 32, to the wall 34 serving as the cooling surface of the cooling apparatus, there is conducted a cooling effect, which then is transmitted to the cooling piece 37 by thermal conductivity. From the cooling piece 37, the cooling effect radiates to the surface 35, thus further cooling the cooling element 32. For example by using gravity, the cooling piece 37 of loading, i.e. cooling, is shifted to get into contact with the surface 35 having a high emission coefficient, so that the effect of conduction, caused by the cooling piece 37 to the wall 34, is interrupted. Around the cooling piece 37, on the side further away from the cooling element, there is arranged at least one radiation shield 43 to prevent the drifting of the cooling effect out of the cooling element 32 during loading or operation. The cooling element 32 advantageously cools the semiconductor detector 39 connected to the cooling element 32, which detector measures the intensity of the radiation received in the measuring window 40 provided in the wall of the cooling apparatus 31. From the semiconductor detector 39, the information obtained in radiation form is conducted to further processing by means of a cable 41, which is installed so that the cable comes out of the cooling apparatus via an outlet 42.

The cooling effect achieved by using the method and cooling apparatus of the invention is described below with reference to the examples.

EXAMPLE 1

The embodiment of FIG. 1 was measured so that the material of the cooling element 2 was stainless steel, standard symbol AISI 303. The diameter of the element 2 was 30 mm, and length 60 mm. When the cooling element 2 was in operational position, the conductive length of the head nearest to the cooling surface 4 from the cooling surface was 2,345 mm. Now the radiation area A of the cooling element 2 was 200 $cm^2$ and volume 32.13 $cm^3$. The cooling element 2 contained ethanol, with a specific melting heat 109 kJ/kg K.

The losses caused by radiation are calculated from the following formula:

$$P=(I_2-I_1)*E/(n+1) \quad (1),$$

where $I=\sigma AT^4$ defined for the emission of a black object, n is the number of radiation shields, $\sigma$ is the Stefan-Boltzmann coefficient, A is the radiation surface, T is the temperature on the Kelvin scale, and E is the emissivity coefficient between two parallel plates; now there can be defined $$E=e_1e_2/(e_2+(1-e_2)e_1) \quad (2),$$

where $e_1$ is the emissivity coefficient of the absorbing surface, and $e_2$ is the emissivity coefficient of the emitting surface. The emissivity coefficients $e_1$ and $e_2$ for the employed surfaces were 0.03. In order to calculate the radiation losses, the temperature of the absorbing surface was chosen to be $T_1=-114°$ C.=159 K, and the temperature of the emitting surface $T_2=30°$ C.=303 K. Thus the obtained values for the radiation losses are P =0.01 W, when n=10, and P=0.13 W, when n=0. The losses caused by heat conduction were calculated from the formula $$P=\lambda*(T_1-T_2)A_1/C \quad (3),$$

where $\lambda$ is the thermal conductivity coefficient, its value for the employed material AISI 316 being 14 W/mK; $T_1$ and $T_2$ are the temperatures of the absorbing and emitting surfaces on the Kelvin scale, $A_1$ is the conductive transversal surface of the sleeve=5.6 $mm^2$ and C is the conductive length between the cooling surface and the head of the cooling element located nearest to the cooling surface=2,345 mm. Now the obtained conductivity loss is P=0.004 W.

The obtained total loss is now P=0.01+0.004=0.014 W, when the number of radiation shields n=10, and P=0.13+0.004=0.134 W, when n=0.

The obtained weight for the ethanol provided inside the cooling element is 0.032 $cm^3$*0.79 g/$cm^3$=25.3 g, in which case the energy content of ethanol is 0.0253 kg*109 kJ/kg =2,757 J.

On the basis of the total losses calculated above, the cooling element remains cold, by means of the energy content of ethanol, for 54.7 h, when n=10, and for 5.7 h, when n=0.

EXAMPLE 2

The cooling apparatus 21 of FIG. 2 was measured so that the shape of its interior was a cylinder with a bottom diameter of 100 mm and height 74 mm. The cooling element 22 installed in the cooling apparatus 21 was a ball with a diameter of 60 mm. The ball was supported with wires with a transversal area of 2 $mm^2$, length 40 mm and thermal conductivity 1 W/mK. The obtained volume for the ball is 100 $cm^3$. The calculated radiation surface for the cooling element is A=41,280 $mm^2$.

By applying the temperatures and emissivity coefficients given in example 1 for the absorbing and emitting surface, and the formulas (1)–(3) of example 1, the obtained value for the losses caused by radiation is P=0.0248 W, when n=10, and P=0.248 W, when n=0, and for the losses caused by conduction P=0.075 W. When the power losses caused by the coolable device itself are taken into account, P=0.025 W, the obtained total losses are P=0.0573 W, when n =10, and P=0.2805 W, when n=0.

When the energy contained in the ethanol volume 100 $cm^3$ is taken into account, it is maintained that the cooling element remains cold for 52.8 h, when n=10, and 10.8 h, when n=0. Although the above specification describes a method of the invention for providing cooling and a cooling apparatus suited for the same essentially in connection with detectors used in analyzers only, it is obvious that the invention can also be applied to other devices requiring low temperatures, within the scope of the appended patent claims.

We claim:

1. A method of operating a rechargeable cooling apparatus that comprises a wall means defining a chamber that is under vacuum, the wall means including at least one thermally conductive wall member that separates the chamber from the exterior of the apparatus, and a cooling element located in the chamber in spaced relationship with the wall means, the cooling element being supported relative to the wall means by support elements of length substantially greater than minimum distance between the cooling element and the wall means, and wherein the method comprises:

placing the thermally conductive wall member in thermally conductive connection with a cryogen, establishing a heat transfer relationship between the cooling element and the thermally conductive wall member, whereby the cooling element is charged, and interrupting the heat transfer relationship between the cooling element and the thermally conductive wall member.

2. A method according to claim 1, wherein the step of establishing a heat transfer relationship between the cooling element and the thermally conductive wall member employs conduction.

3. A method according to claim 2, wherein the step of establishing a heat transfer relationship between the cooling element and the thermally conductive wall member comprises placing the cooling element in thermally conductive contact with the thermally conductive wall member.

4. A method according to claim 1, wherein the step of establishing a heat transfer relationship between the cooling element and the thermally conductive wall member employs both conduction and radiation.

5. A method according to claim 4, wherein the step of establishing a heat transfer relationship between the cooling element and the thermally conductive wall member comprises moving a transfer member that is located in the chamber between a first position in which it is in thermally conductive contact with the thermally conductive wall member and is spaced from the cooling element, whereby the cooling element is charged by radiation, and a second position in which it is spaced from the thermally conductive wall.

6. A method according to claim 5, wherein the transfer member is in contact with the cooling element when in its second position.

7. A method according to claim 1, wherein the step of establishing a heat transfer relationship between the cooling element and the thermally conductive wall member comprises placing the cooling element in contact with the thermally conductive wall member, and the step of interrupting the heat transfer relationship between the cooling element and the thermally conductive wall member comprises separating the cooling element from the thermally conductive wall member.

8. A method according to claim 1, wherein the step of establishing a heat transfer relationship between the cooling element and the thermally conductive wall member comprises displacing the thermally conductive wall member into contact with the cooling element, and the step of interrupting the heat transfer relationship between the cooling element and the thermally conductive wall member comprises displacing the thermally conductive wall member out of contact with the cooling element.

9. A rechargeable cooling apparatus comprising:

a wall means defining a chamber, the wall means including at least one thermally conductive wall member that separates the chamber from the exterior of the apparatus, means for placing the chamber under vacuum, a cooling element located in the chamber in spaced relationship with the wall means, the cooling element being supported relative to the wall means by support elements of length substantially greater than minimum distance between the cooling element and the wall means, and a means for selectively establishing and interrupting heat transfer relationship between the cooling element and the thermally conductive wall member, whereby the cooling element is charged when the thermally conductive wall member is in thermally conductive connection with a cryogen.

10. Apparatus according to claim 9, wherein the wall means has an inner surface having an emission coefficient in the range 0.01–0.3 and the cooling element has an outer surface with an emission coefficient in the range 0.01–0.3, and the support elements have a thermal conductivity in the range 0.01–150 W/mK.

11. Apparatus according to claim 10, wherein the thermal conductivity of the support elements is in the range 0.1–15 W/mK.

12. Apparatus according to claim 9, wherein the support elements allow movement of the cooling element inside the chamber.

13. Apparatus according to claim 9, wherein the support elements support the cooling element in a manner substantially preventing movement of the cooling element inside the chamber.

14. Apparatus according to claim 9, wherein the cooling element is substantially cylindrical.

15. Apparatus according to claim 9, wherein the cooling element is substantially spherical.

16. Apparatus according to claim 9, wherein the cooling element is solid.

17. Apparatus according to claim 9, wherein the cooling element is hollow.

18. Apparatus according to claim 9, wherein the cooling element comprises a hollow shell containing a material that has a phase transformation from solid to liquid within the temperature range from −273° C. to +1° C.

19. Apparatus according to claim 9, wherein the cooling element comprises a hollow shell containing a material that has a phase transformation from solid to liquid within the temperature range from −200° C. to −100° C.

20. Apparatus according to claim 9, wherein the cooling element comprises a hollow shell containing a liquid or a gas in the liquid phase.

21. Apparatus according to claim 9, wherein the cooling element comprises a hollow shell filled with ethanol.

22. Apparatus according to claim 9, wherein the cooling element comprises a hollow shell filled with propane.

23. A rechargeable cooling apparatus comprising:

a wall means defining a chamber, the wall means including at least one thermally conductive wall member that separates the chamber from the exterior of the apparatus, means for placing the chamber under vacuum, a cooling element located in the chamber in spaced relationship with the wall means, the cooling element being supported relative to the wall means by support elements of which length is substantially greater than minimum distance between the cooling element and the wall means, a cryogen disposed in thermally conductive connection with the thermally conductive wall member, and a means for selectively establishing and interrupting thermally conductive connection between the cooling element and the thermally conductive wall member, whereby the cooling element is charged.

* * * * *